US005432970A

United States Patent [19]

Reid

[11] Patent Number: 5,432,970

[45] Date of Patent: Jul. 18, 1995

[54] FLOOR TREATMENT MACHINE

[76] Inventor: Larry Reid, 60 Cassandra Blvd. Unit #8, Don Mills, Ontario, Canada, M3A 1S6

[21] Appl. No.: 180,905

[22] Filed: Jan. 12, 1994

Related U.S. Application Data

[63] Continuation-in-part of Ser. No. 11,254, Jan. 29, 1993, abandoned.

[51] Int. Cl.[6] ..... A47L 11/162; A47L 11/40

[52] U.S. Cl. ..... 15/49.1; 15/246

[58] Field of Search ..... 15/28, 29, 49.1, 50.1, 15/98, 385, 246, 180, 257.01; 51/177, 268, 271, 273, 274

[56] References Cited

U.S. PATENT DOCUMENTS

| | | | |
|---|---|---|---|
| 2,626,412 | 1/1953 | Petersen | 15/50.1 |
| 3,010,135 | 11/1961 | Pollnow, Jr. | 15/49.1 |
| 3,011,191 | 12/1961 | Hulsh | 15/180 X |
| 3,027,581 | 4/1962 | Holt | 15/49.1 |
| 3,100,903 | 8/1963 | Doyle, Sr. | 15/49.1 |
| 3,148,397 | 9/1964 | Kuchar et al. | 15/246 X |
| 3,153,251 | 10/1964 | Ohlson | 15/50.1 |
| 4,809,385 | 3/1989 | Bogue | 15/246 |
| 4,845,798 | 7/1989 | Genovese | 15/98 |

*Primary Examiner*—Edward L. Roberts

[57] ABSTRACT

A floor machine for stripping, washing or otherwise treating the surface of the floor with a rotating treatment disc such as a brush or a pad. A protective skirt over the pad is arranged to "float", i.e. to drop freely over the disc with a view to minimizing the clearance between the floor and the skirt without detracting from the even ride of the disc over the floor.

14 Claims, 13 Drawing Sheets

38
40
42
10
26
28
45
31
32
12
30
14
68
36
34
44
48
66
60
64
16

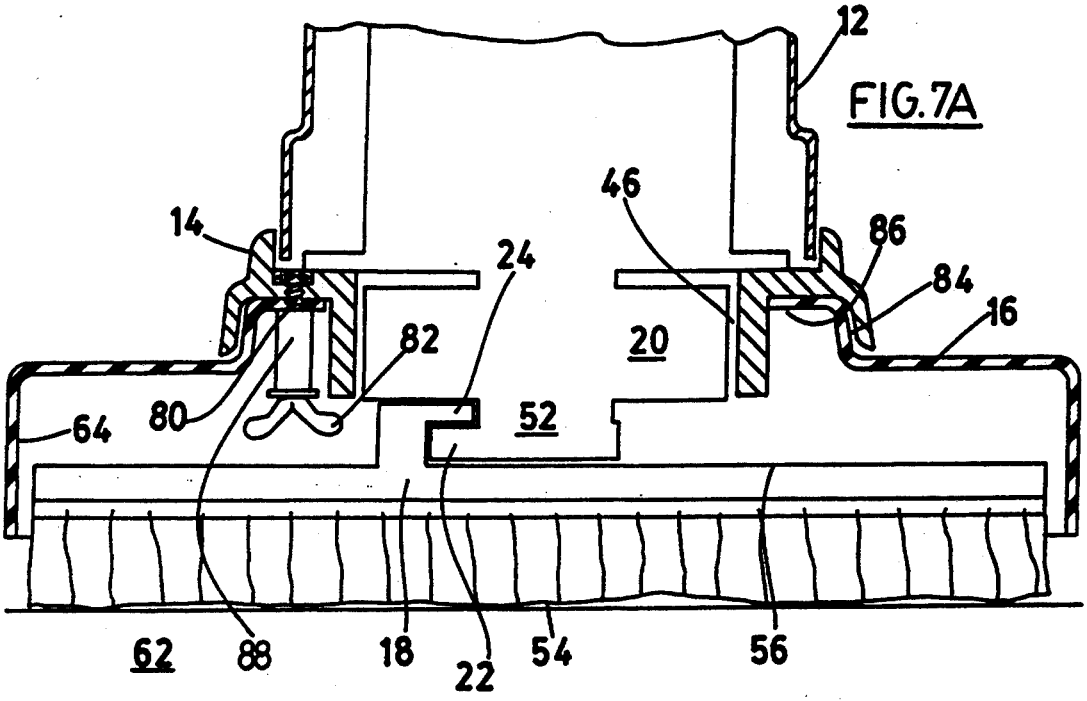
FIG.7A
FIG.7B
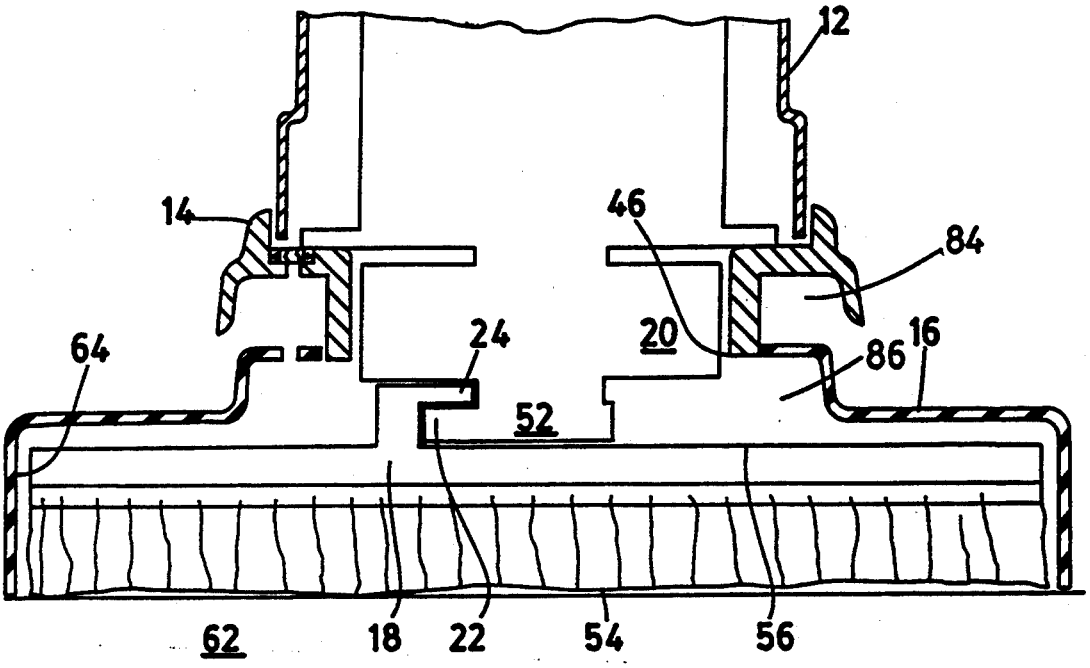

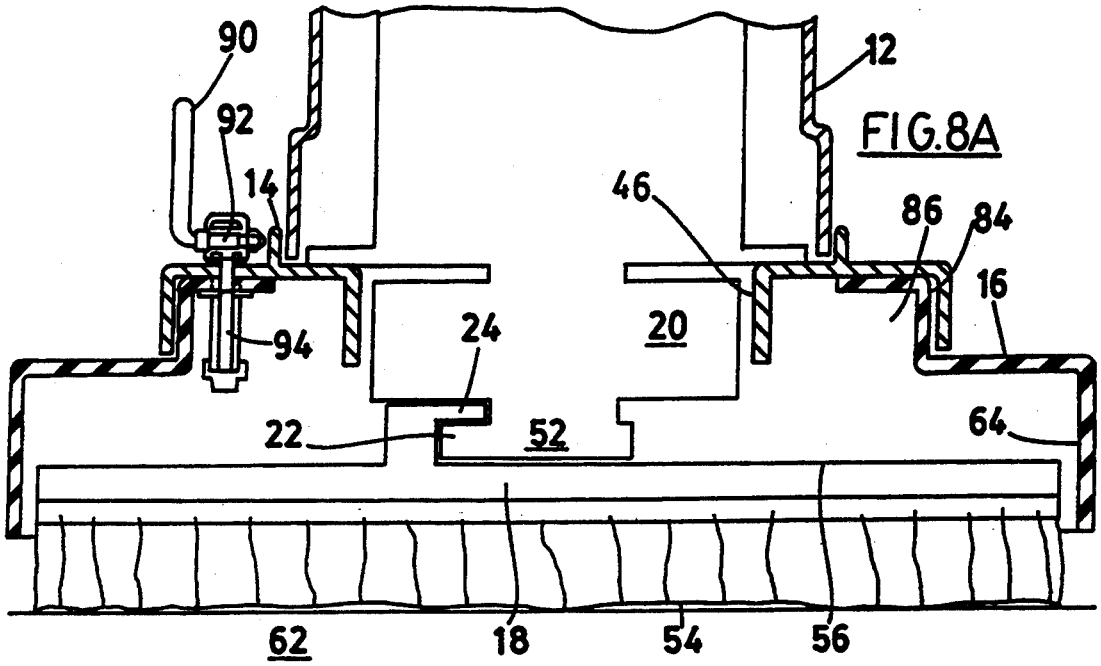
FIG.8A
FIG.8B
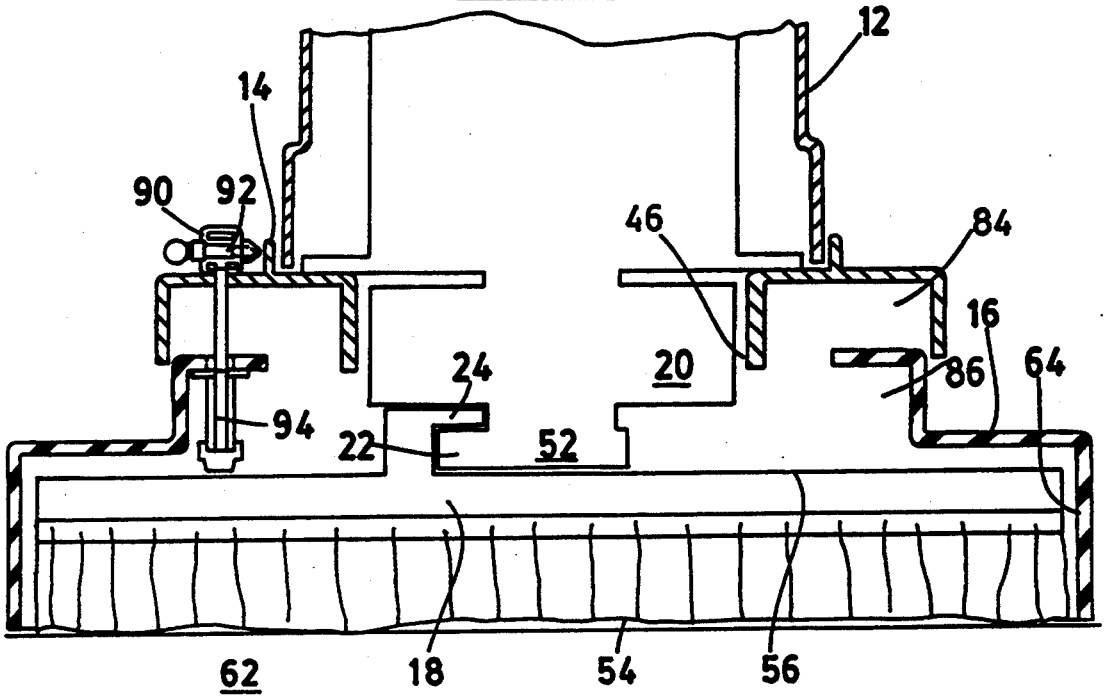

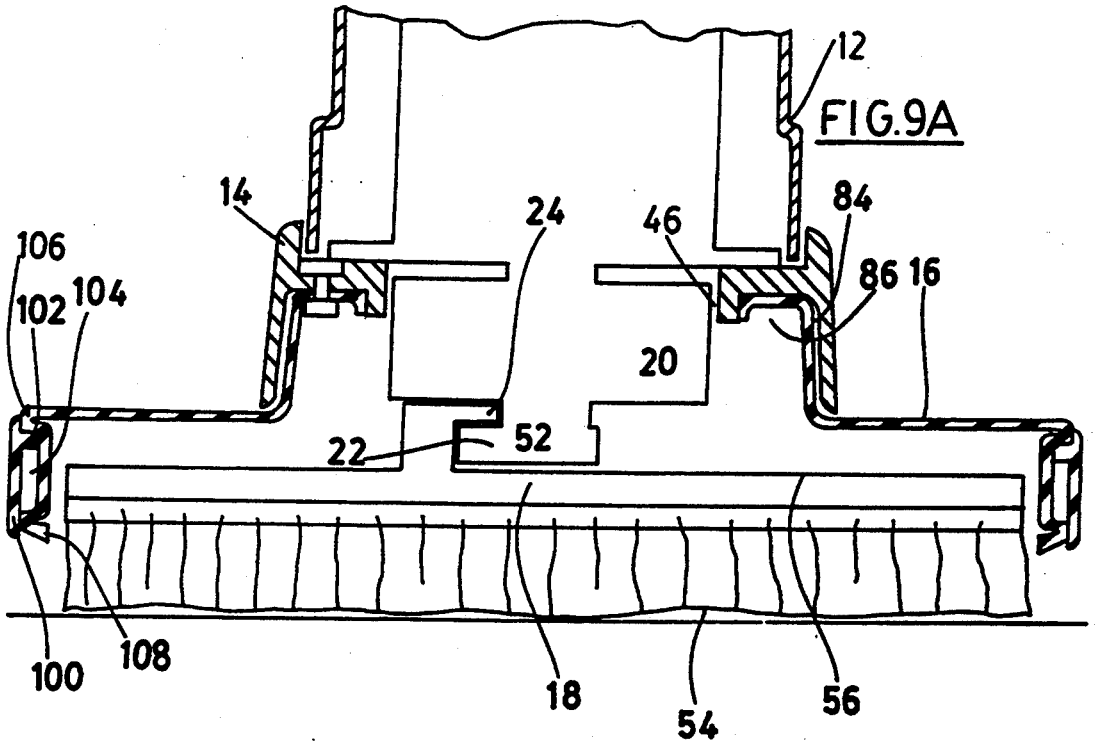
FIG.9A
FIG.9B
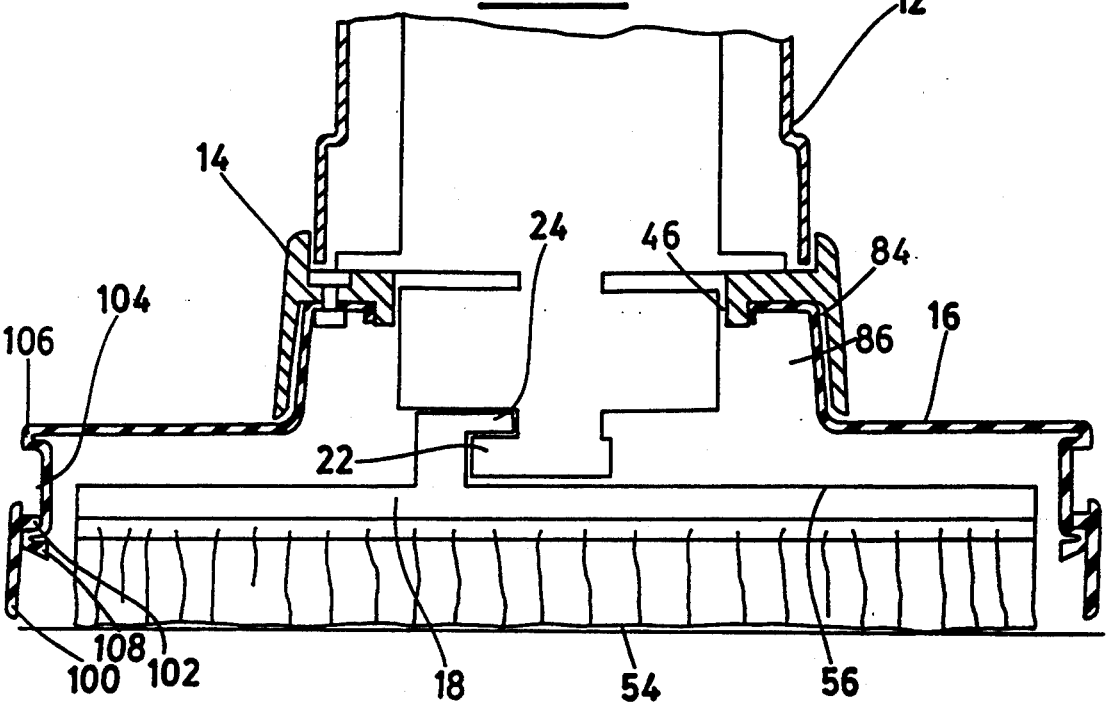

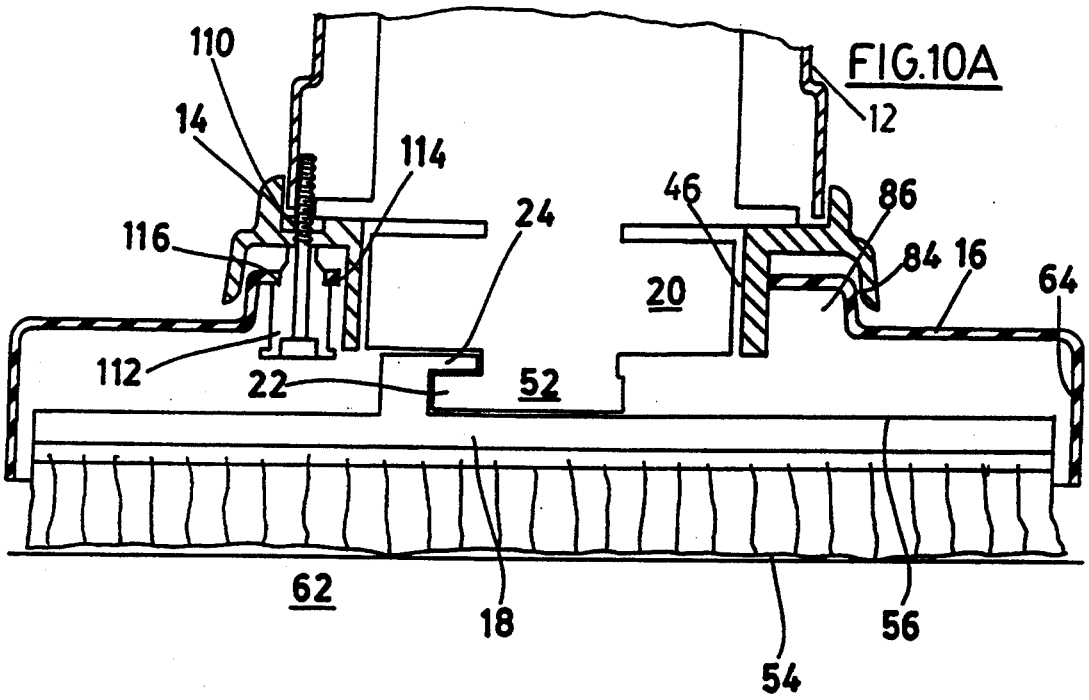
FIG.10A
FIG.10B
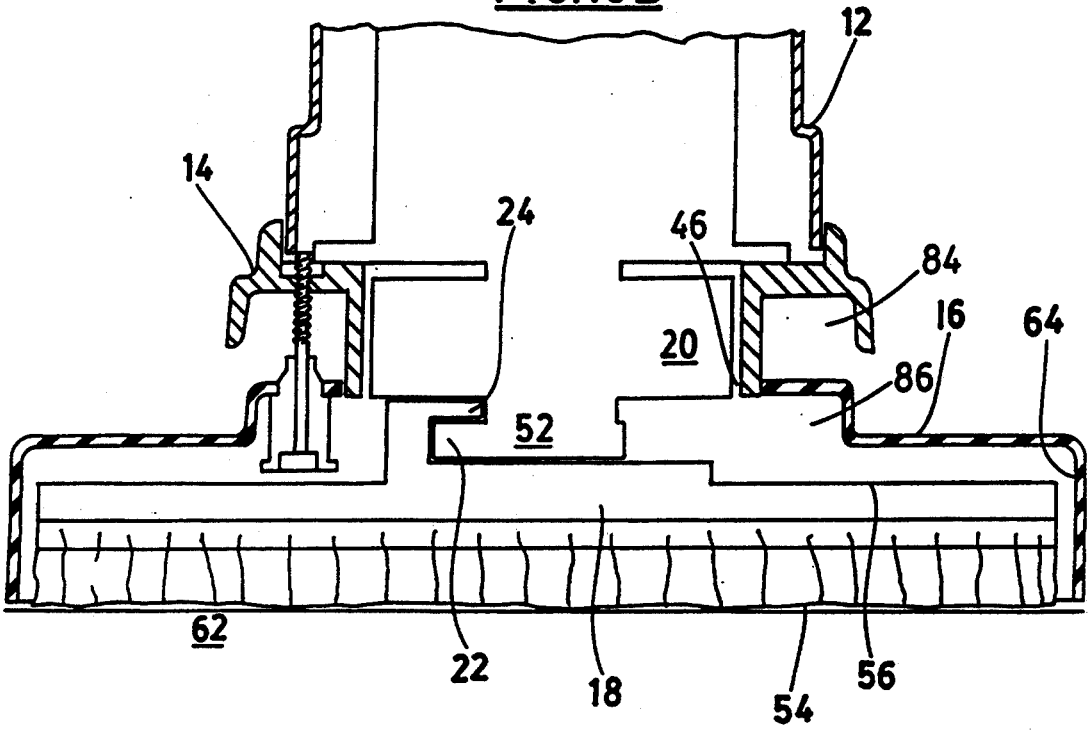

FLOOR TREATMENT MACHINE

This application is a continuation-in-part application of U.S. patent application Ser. No. 08/011,254, filed Jan. 29, 1993, which is abandoned on filing of this application.

BACKGROUND OF THE INVENTION

1. Field of the Invention

The invention relates to floor machines for waxing, stripping or otherwise treating floors by means of rotating brushes, pads or other means for treating the surface of a floor.

2. Acknowledgement of prior art

Floor machines for commercial, industrial or heavy duty use for stripping, washing, or otherwise treating the surface of a floor by rotating treatment discs are well known. Generally, they comprise an electric motor for rotating the treatment means and have a handle so that they may be operated by a standing operator. Such machines will be referred to herein as "floor machines".

Floor machines intended for heavy duty use, however, often comprise a single, circular disc-like brush having a generally planar surface attached to the motor of the machine through a vertical drive shaft through the center. Whether a single brush or pad or whether a plurality of brushes or pads are used, the floor machine is usually provided with a fixed position protective covering hood covering the treatment means and intended to protect the walls and furniture from the risk of being hit and damaged by the spinning brush or pad.

Such protective hoods covering the pads or brushes do not extend downwardly to the extent that they are actually in contact with the floor. Known machines provide hoods which are clear from the floor in operation. The extent of the clearance is sufficient to create a problem when liquids are being used with the floor machine. Liquids, such as water or wax-stripping liquids, are propelled by the rotating brushes or brush through the clearance gap between the floor and the skirt. It is the nature of the function of the device that such liquids will be very dirty and, in the case of wax stripping liquids, very corrosive. To remove the splashed, dirty wax and stripping liquid from painted surfaces, baseboard, furniture, walls, etc. is extremely time consuming and costly.

It has not been thought possible to provide a hood with no clearance between the floor and the machine itself, since the hoods have been made of rigid material and are fixed to the motor. If clearance is not provided between the floor and the skirt, the rigid hood will scratch and ruin the floor surface. Moreover, the polisher does not ride evenly while it is being operated but tilts to the right or to the left according to the circumstances. Thus, even if clearance is provided it must be sufficient that there is little risk of the hood scratching the floor even when the floor machine is tilted.

As a partial solution to this problem it has been proposed to make the hood of flexible material, for example, rubber, in the hope that it will not catch too badly on any projection or unevenness.

It has also been prosed to provide the hood with an adjustable annular splash guard about its periphery. Such a solution is proposed by Bogue in U.S. Pat. No. 4,809,385 issued Mar. 7, 1989. Bogue's machine has a splash guard surrounding the hood, the level of the splash guard being adjustable within a specific range.

Another such solution is proposed by Pollnow Jr. in U.S. Pat. No. 3,010,135 which provides an annular splash guard surrounding the hood. Pollnow's splash guard is loosely fitted about the hood so that it rests on the floor and is dragged over the floor during operation of the machine. The hood, itself, is however permanently fixed about the central motor, the diameter of the hood thus being fixed to inhibit the fitting of larger brushes or pads.

The applicant has addressed these problems.

SUMMARY OF THE INVENTION

Thus, according to the invention there is provided a floor machine comprising a rotatable floor treatment disc having a floor treatment surface and an upper surface; a motor to drive said disc on a drive shaft; a hood having a generally flat portion extending from the motor over and a downward portion extending peripherally downwardly over the disc; a collar about the shaft and fixed in position with respect to the motor; fastening means to fasten the flat portion of the hood to the collar in a first working position with respect to the motor and the disc to leave a clearance between a first plane defined by a lower rim of the periphery of the hood and a second plane defined by the treatment surface; the fastening means being releasable to allow the hood to drop freely over the disc to a free position in which the first and second planes are coincident. Preferably, the disc is located to support the machine on the floor. A pair of axially aligned wheels may also be provided, the wheels bearing in a rearwardly directed extension on the collar.

The term "generally flat" is intended to include hoods having a cover portion having a slight slope or dome.

Vertical guides may be provided to restrain the hood to drop vertically over the disc to its free position, and inhibit tendency of the hood to rotate with the disc. The vertical guides lie between the collar and the flat portion of the hood.

An elongate handle is pivoted to the collar to pivot between an upright position vertical to the plane of the disc and the plane of the hood and a flat position generally parallel to the plane of the disc and plane of the hood. The handle may have a releasable clamping sleeve thereabout, the sleeve being clampable in a fixed position on the handle and releasable to slide thereon, and a strut pivoted at one end to the clamping sleeve and, at another end, to the collar extension, whereby sliding of the clamping sleeve on the handle moves the handle between the upright and flat position. The sleeve may be clampable to fix the handle in intermediate position convenient to an operator. Conveniently the handle terminates at a distal end with a pair of branching handle bars. A hook may project form the handle, the hook and at least one handlebar forming a rack for winding electrical cord thereon. In this case, winding the sleeve on the handle toward the distal end acts to loosen electrical cord wound between the hook and at least one handlebar.

Preferably, both the floor treatment disc and the hood are releasably attached to the drive shaft and the collar respectively so that they may be interchanged for units of different sizes. Indeed, if the floor treatment disc is of a diameter less than that of the collar, the machine might for some purposes be used without the hood. In this case, the collar extends outwardly of the disc to provide some protection to the user. Moreover, when the hood is present it may be provided with a connection to a vacuum unit mounted on the handle so that dust may be vacuumed out from within the hood.

BRIEF DESCRIPTION OF THE DRAWINGS

An embodiment of the invention will now be described by way of example with reference to the drawings, in which:

FIGS. 7A and 7B show detailed sections of the mechanism for releasing the hood of another embodiment;

FIGS. 8A and 8B, show detailed sections of the mechanism for releasing the hood of yet another embodiment;

FIGS. 9A and 9B show detail section of raised and lowered positions of another embodiment of the hood mechanism;

FIGS. 10A and 10B show detailed sections of the mechanism for releasing the hood of yet another embodiment.

DETAILED DESCRIPTION OF A PREFERRED EMBODIMENT

Figure 1:
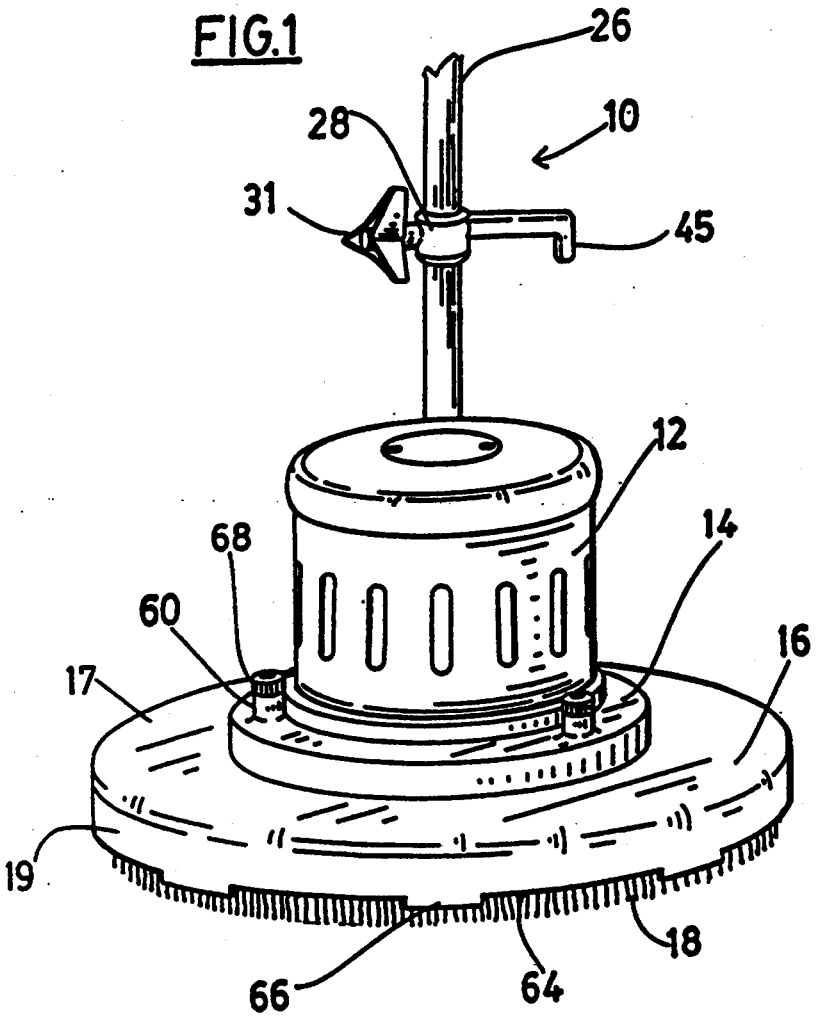
FIG. 1 is a view of a floor machine according to the invention as seem from the front, with the hood in fixed position.

Referring first to FIGS. 1 to 6, a floor machine 10 comprises a motor housing 12 for an electric motor, an anchor collar 14 supporting the housing 12 and having a protective hood 16 attached to it. The hood 16 comprises a generally flat cover part 17 and a downward peripheral part 19 unitary with the cover part. The hood 16 covers a floor treatment disc 18, which is detachably connectable to a drive rotor 20 of the motor. The disc is connectable to the drive rotor 20 through interacting lugs 22 of the rotor and lugs 24 of the disc.

The disc itself is removable to be interchangeable with the other discs for specialist purposes or for smaller or larger discs. Thus, it may be desired to use a brush for one purpose and a polishing pad for another purpose. The disc 18 as illustrated in the drawings is shown as a brush, but it will be appreciated that abrasive pads, polishing pads, hard discs with sanding surfaces, or other abrading surfaces may be used. Moreover, the brush may be of a variety of materials. For example, the brush may be a wire brush, a bristle brush, a nylon brush or other type of brush having a stiffness suitable to the treatment to be performed. The pad may be a felt pad, a nylon pad, a scouring pad etc.

The hood 16 is also interchangeable with other smaller or larger hoods in a manner to be described hereinafter.

An elongate handle 26 is pivoted to the collar 14 at a pivot point 36 so that it may be located in an upright position vertical to the plane of the generally flat hood cover portion 17 and the plane of the brush 18 may lie generally parallel to these planes in a flat position. Thus the handle 26 pivots through a full right angle. In the vertical position of the handle 26 the floor machine may be "parked" with its treatment disc flat on the floor and supporting the machine as may be seen in FIG. 4B. With the handle 26 in the flat position, the machine may be stored with, for example, the disc and the hood vertical to the floor and parallel with the vertical support surface against which the machine may lean.

Figure 4A:
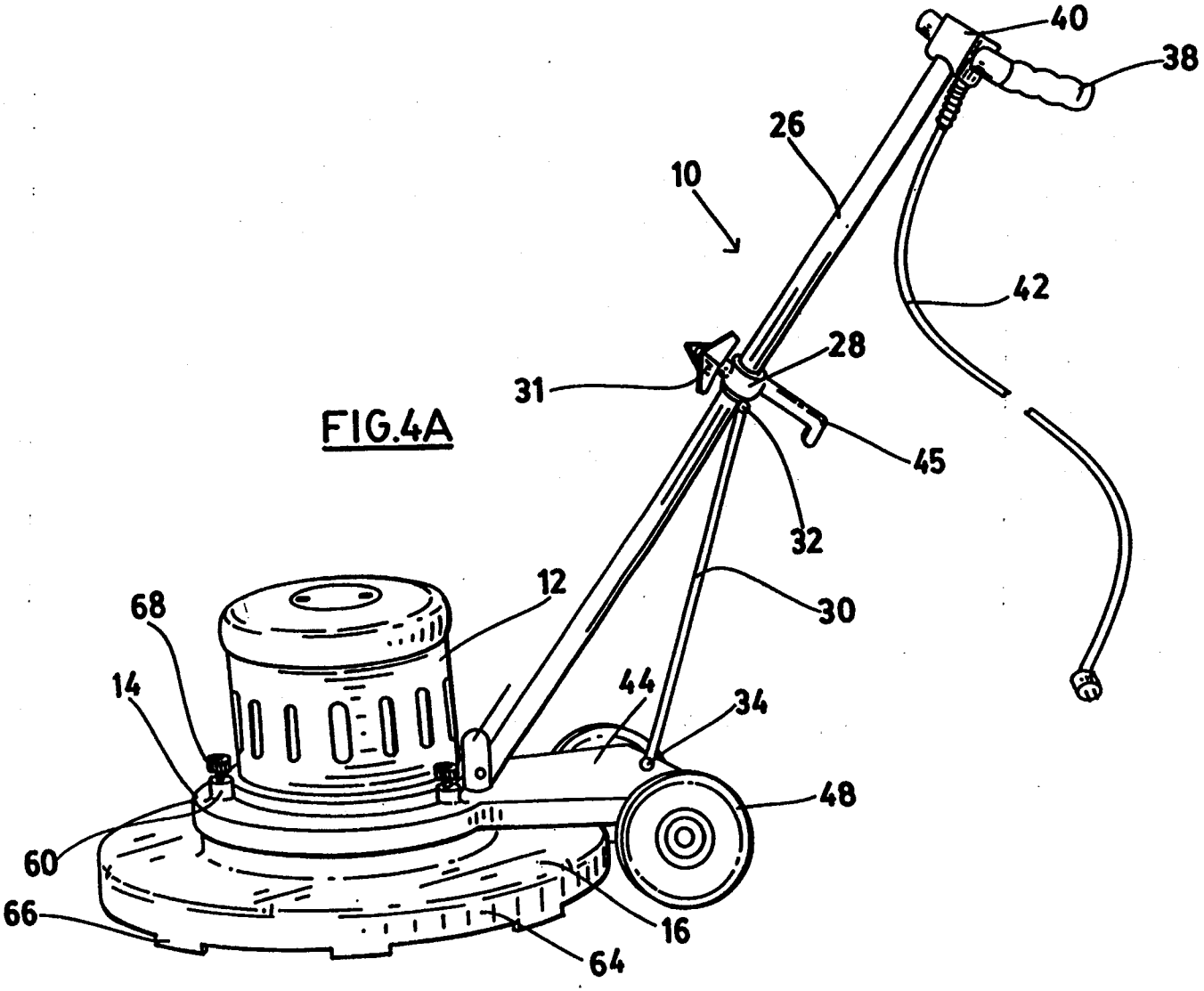
FIG. 4A is a view of the floor machine of FIGS. 1, 2 and 3 as seen from the side in working position.
Figure 4B:
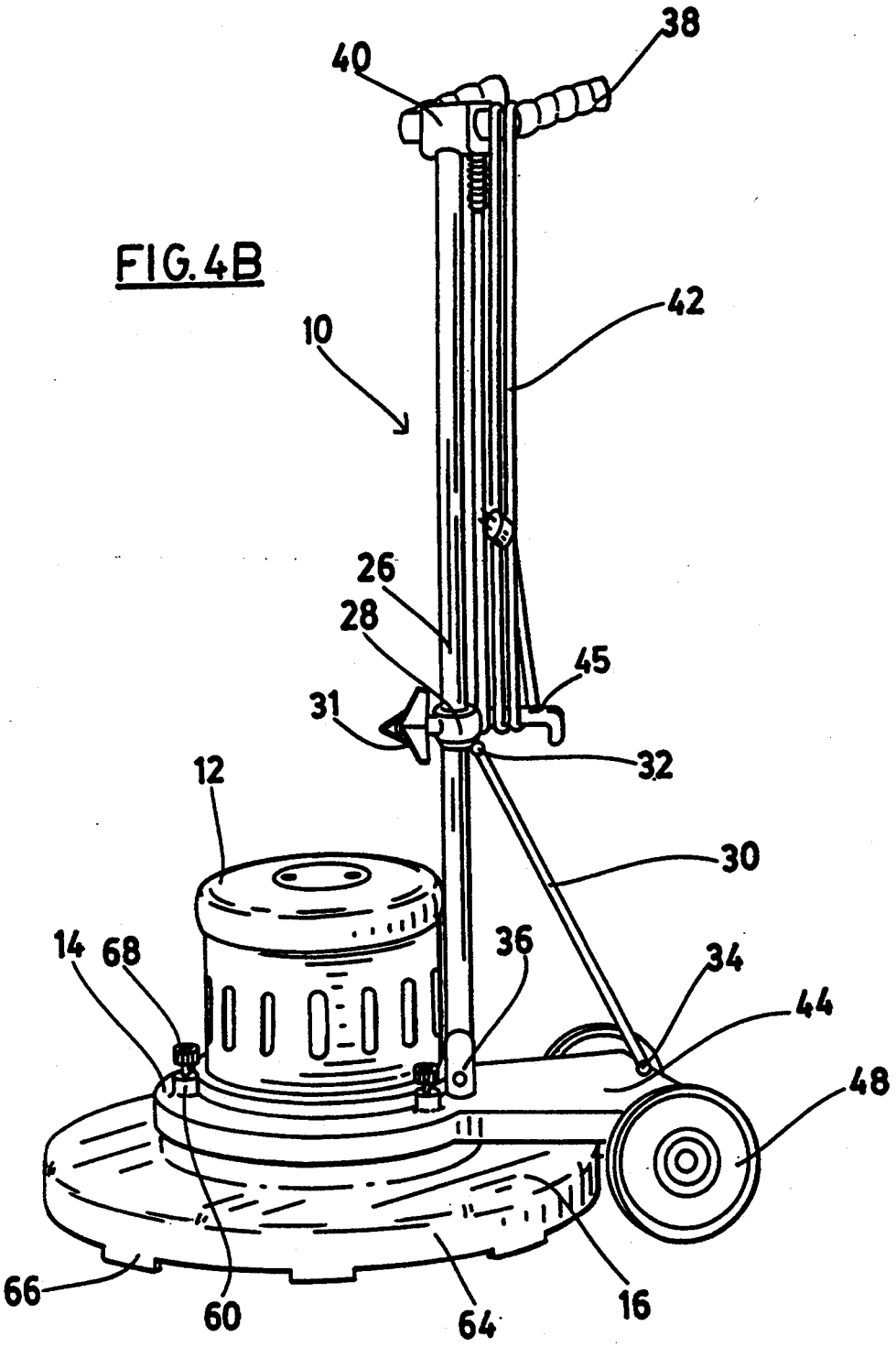
FIG. 4B is a view of the floor machine of FIGS. 1, 2 and 3 in "parked position"
Figure 5:
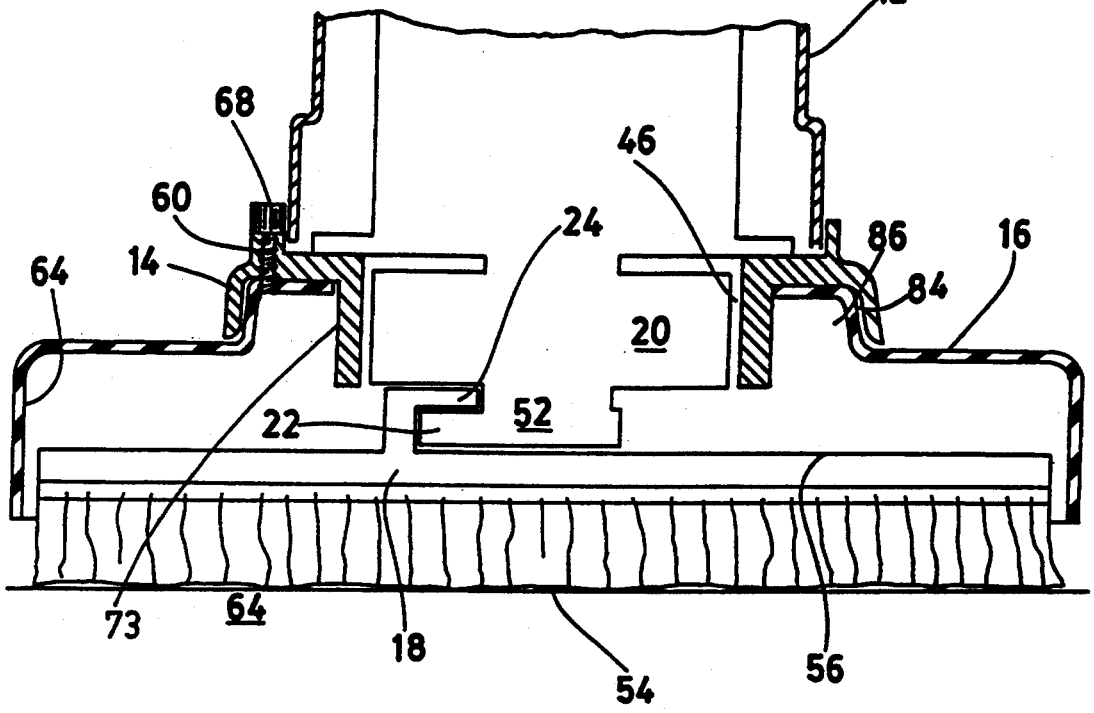
FIG. 5 is a section of FIG. 1 on the line V—V.
Figure 6:
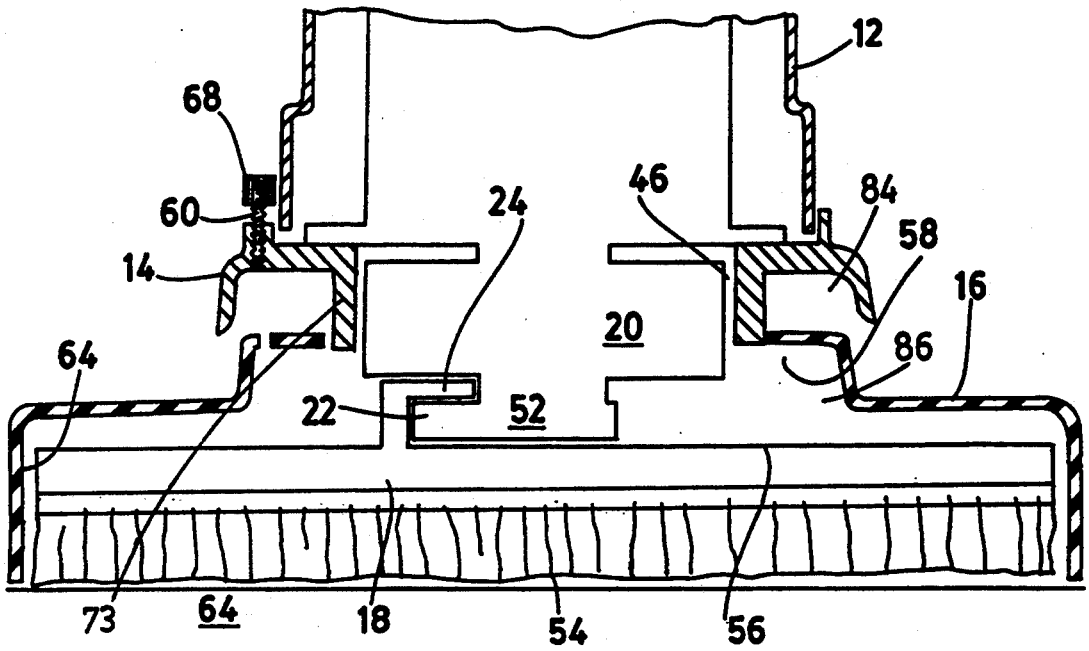
FIG. 6 is a section of the floor machine of FIG. 2 on the line VI—VI.

In operation, the handle 26 will be at an intermediate position between the vertical position and the flat position. This intermediate position, an example of which is shown in FIG. 4A, is a matter of choice of the operator. Conveniently, a sleeve is provided to slide on the handle 26. It may be provided with any suitable clamping means to affix it in a chosen location. Conveniently, the clamping means may be a clamping bolt 29 extending in screw threaded engagement through a screw threaded orifice in the sleeve to force an end of the bolt into engagement with the handle 26. Manual operating means such as a tap handle or a spoked handle 31 may be provided for the clamping bolt.

An elongate strut 30 may extend from a pivot point 32 on the sleeve to a pivot point 34 radially spaced on the collar from the pivot point 36 of elongate handle 26. Thus, sliding of the sleeve 28 on the handle 26 is limited in one direction by the length of the strut. Sliding of the sleeve 28 on the handle 26 causes pivoting of the handle 26 about its pivot point 36 through a range of intermediate positions. An operator may choose a suitable intermediate position which is comfortable for his use and may then clamp the sleeve 28 in position by rotation of bolt 29 by handle 30 to engage the distal end of bolt 29 with the handle 26.

The distal end of the handle 26 is provided with a pair of branching handlebars 38. Between the handlebars 38, where they branch from the distal end of handle 26, an electrical junction box 40 may be provided. From the junction box 40 a cable may extend within the handle 26 to the electric motor through a suitable orifice in housing 12. A further length of electric cable 42 is provided for connection to an electric outlet. Various methods may be provided for the storage of this electrical cable, but conveniently, it is wound between a hook extending from the handle and one of the handlebars 38. It is particularly convenient to provide the hook 45 on the sleeve 28. When work with the floor machine is finished the handle 26 is placed in its upright "parked" position and the cable 42 is wound around the hook 45 and one of the handlebars 38. When it is desired to re-start work, the handle 26 is moved into its operating position by sliding the sleeve 28 up the handle to move the handle into desired intermediate position. This reduces the distance between the hook 45 and the handle bars 38. The coils of cable 42 may fall to the floor unaided. At least they are loosed sufficiently that unwinding them from their stored position is not onerous.

The anchor collar 14 comprises the main chassis member of the illustrated embodiments. It may included an extension which protrudes radially from the main part of the collar. Handle pivot point 36 is located towards an inner rim 46 of the collar on a radius running centrally of the extension 44. Lower pivot point 34 of the strut 30 is located further from the inner rim 46 on the same radius of the extension 44. Thus, the handle 26, the strut 30 and the associated pivot points 32, 34 and 36 lie in a plane bisecting the extension 44.

As illustrated, the extension 44 carries a pair of parallel wheels, having their planes parallel with the plane bisecting the extension 44 and equally spaced from it. These wheels 48 may facilitate transportation of the floor machine. They may be arranged on individual axles or an a common axle.

The inner rim 46 of collar 14 defines a recess 50 for the housing 12 of the motor. The recess 50 conforms to the shape of the housing of the motor which, as illustrated, is circular. From the base of the housing 12 the drive rotor 20 accesses the underside of the hood through an open circular orifice. The drive rotor 20 is provided with a central boss 52 having attachment lugs 22 for connecting the disc 18 to the drive rotor 20.

Disc 18 is provided with a lower surface 54 which, as illustrated, is a brush surface. As previously commented, the treatment surface may be a pad or abrasive surface for other purposes. The disc 18 also comprises an upper surface 56, having upwardly and inwardly extending lugs 22. The disc 18 is simply attached and locked into position on boss 52 by positioning lugs 22 radially adjacent to lugs 24 and rotating the disc 18 so that lugs 22 lock into position above lugs 24.

Hood cover portion 17 has a central orifice 58 to allow boss 52 to protrude therethrough. The hood 16 is, as shown in FIG. 1, attached to collar 14 by means of bolts 60 so that there is clearance between the floor 62 and the lower rim 64 of the hood peripheral portion 19. In this instance the floor machine rides on the lower treatment surface 54 of the disc 18 with clearance between floor 62 and the hood 16. For many applications of the floor machine the hood is suitably located in this position.

For application where the floor surface finish, such as floor wax, is to be removed with the usual very corrosive chemical this clearance between the floor 62 and the hood 16 is undesirable. It is, therefore an important feature of this invention, that the whole hood 16 is detachable from the collar 14 so that it rides on the floor covering the disc 18. By this means, the hood may be lowered so that the lower rim 64 of its peripheral portion 19 contacts the floor 62 or so nearly contacts the floor as to effectively constrain liquid or loose particles within its periphery.

The hood 16 may be made of light plastics material which is both resilient and not so heavy that damage to the floor is likely when the hood is lowered.

Figure 2:
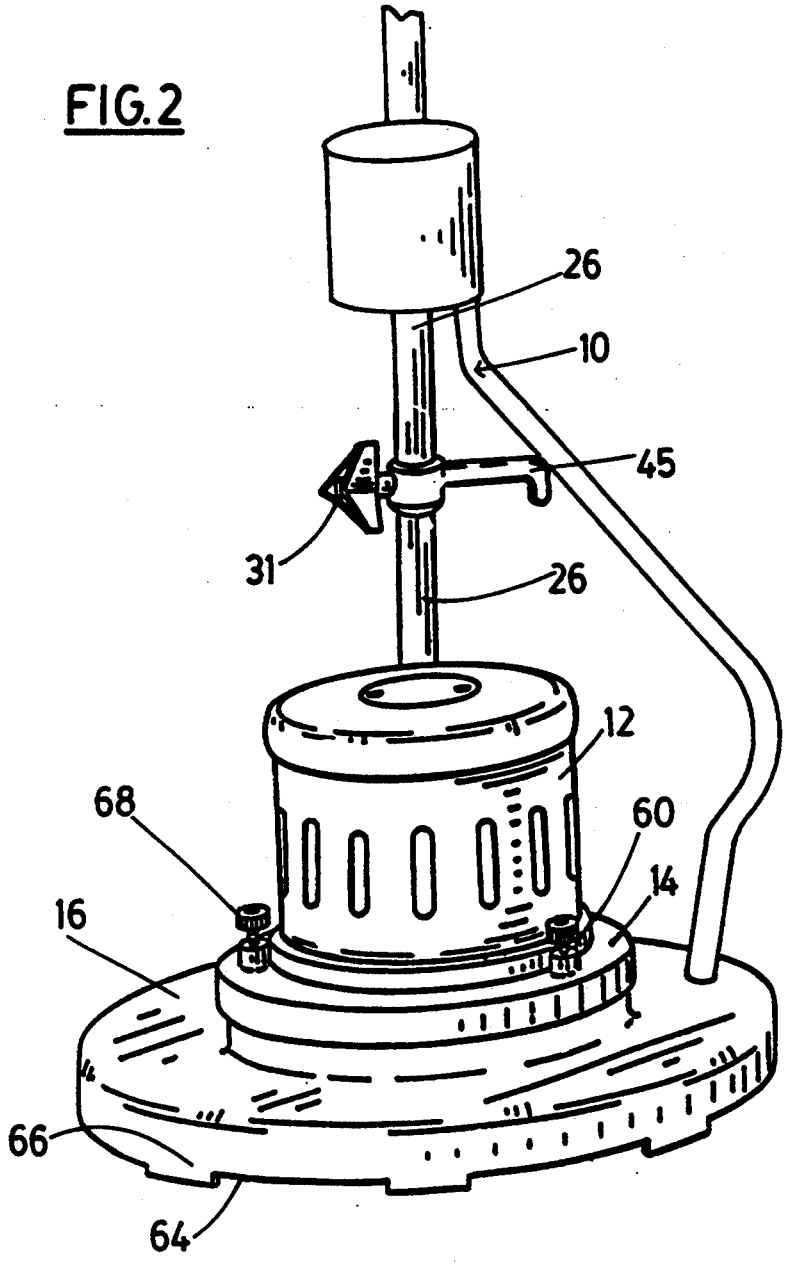
FIG. 2 is a view of the floor machine of FIG. 1 from the front, but with the hood in free position and including a vacuum unit.

It may or may not be undesirable that the hood should exert any suction effect on the floor depending on the use to which it is being put. When such suction is undesirable, small tabs 66 are provided, extending downwardly from the periphery of the hood to avoid direct contact of the periphery with the floor over its whole length. These tabs 66 may be useful in allowing the exchange of clean and dirty fluid on the floor (or other particles) without permitting so much clearance that splashing or escape of abrasive particles occurs from under the skirt. The tabs 66 may be of suitably small depth that suction is possible when desired. Alternatively they may be absent for machines capable of exerting suction. Difficulties that might be encountered with a fixed hood in encountering unevenness in the floor may not occur with the free hood as illustrated in FIG. 2. During application of the floor machine to the floor, the hood will lift on encountering a small protuberance from the floor or an unevenness. Of course, major obstacles are not included by the term "small protuberances".

FIG. 2 shows a machine capable of exerting suction within the hood. A vacuum unit 27 is mounted on the handle 26 and connected to the interior of the hood by means of hose 29. The vacuum unit may be activated by a switch as desired.

The releasable connection of the hood 16 to the collar 14 may be achieved by a variety of mechanisms, as will be appreciated by one skilled in the art. A number of such mechanisms are described here by way of example only.

The floor machine depicted in FIGS. 1 to 6 includes releasable fastening means for the hood comprising bolts 60 in screw threaded engagement with a screw threaded drill through the collar 14. The bolts 60 extend completely through the collar to engage similarly screw threaded sockets or drills in the skirt itself. Each bolt 60 has a knurled head 68 for manual screwing and unscrewing. When it is desired to allow the hood 16 to float over the disc 18 the bolts may be easily released from the skirt by hand operation. As shown, three bolts 60 are provided, but the number may be variable.

Figure 3:
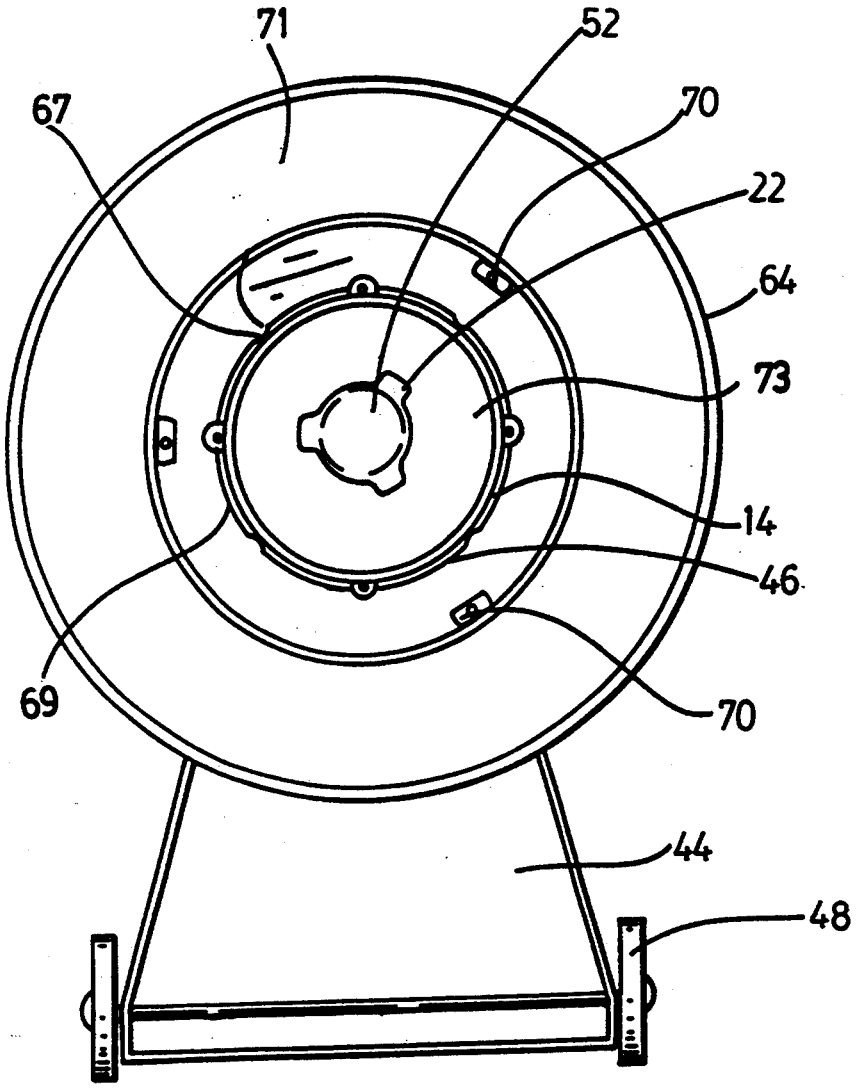
FIG. 3 is a view of the floor machine of FIG. 1 as seen from beneath the hood with the disc removed.

It may be undesirable that the hood 16, when floating freely over the disc 18, be free to rotate with it. Therefore means to prevent rotation of the hood may be provided. For example, the hood may be provided with vertical guides. These vertical guides may be shoulders 67 on its inner rim 69 which engage grooves 71 on a depending portion 73 of the inner ring 46 of the collar 14 to slide freely thereon (see FIG. 3). It is of course possible that the grooves be on the hood and the shoulders on the collar. The hood is conveniently made of semi-flexible material, such as rubber, polyurethane, polyethylene, etc. Since it is desirable that it should not be made of a material that will scratch the floor. Fixing sites for the bolts 60 may be provided by metal inserts 70 in the skirt 16. These inserts are best seen in FIG. 3, and may be provided on the underside of the hood 16 and need not extend through the thickness of the skirt.

FIGS. 7A and 7B show a very similar attachment system for the skirt as that shown in FIGS. 1 to 6. The FIG. 7 attachment system, however, comprises bolts 80 which are releasable from beneath the hood 16 by means of butterfly heads 82. This system is less desirable than that of FIGS. 1 to 6, since it mat be necessary to remove the disc 18 prior to adjustment of the bolt 80. In this case the inner portion of the hood 16 is recessed into a channel 84 of the collar 14 to make a space for operation of bolt 80.

A spacer 88 may be provided to hold the skirt 16 into its upper position as shown in FIG. 7A. This spacer 88 may be removed to allow the skirt to descend into its free position. Alternatively the bolt 80 may be removed completely.

FIGS. 8A and 8B show further mechanism for raising and lowering the hood 16. The principle of the operation is similar to that described earlier, but a rotatable lever 90 is utilised to raise and lower the hood 16. Rotatable lever 90 is connected to a cam 92 (shown roughly in section). Rotation of the lever 90 from the position shown in FIG. 8A to the position shown in FIG. 8B rotates cam 92 from the position shown in FIG. 8A in which its shorter radius allows the hood 18 to be in its raised position to the position shown in FIG. 8B in which its longer radius allows hood 16 to be in its lowered position. Cam 92 is connected to support member 94 which, in FIG. 8A is at one end of the cam track holding the hood 16 in its upper position. In FIG. 8B the support member 94 is in position at the other end of the cam track and has allowed the hood 16 to drop.

FIGS. 9A and 9B show similar raised and lowered positions of another embodiment of the hood mechanism. In FIGS. 9A and 9B the hood 16 is provided with a movable, telescoping peripheral sleeve 100. Sleeve 100 is provided with a series of inwardly projecting, locking ribs 102, which slide upwardly and downwardly in groove 104 of main hood member 16. The hood 16 is provided with a complementary series of locking ribs 106. In the upper position to raise and lower the sleeve 100, it is rotated from the position shown in FIG. 9A so that locking ribs 102 are not engaged with complementary locking ribs 106. The sleeve 100 is now free to slide downwardly in groove 104 until locking ribs 106 reach the lower wall 108 of groove 104. This is the position shown in FIG. 9B. In order to raise the skirt the procedure is reversed.

FIGS. 10A and 10B show a modification of the embodiment of FIGS. 7A and 7B. In FIG. 10A a screw threaded bolt 110 is provided with a carrier member 112 for an inner rim 114 of hood 16. Unscrewing or screwing up of the bolt raises or lowers skirt 16 on shoulder 116 of support member 112.

Figure 11A:
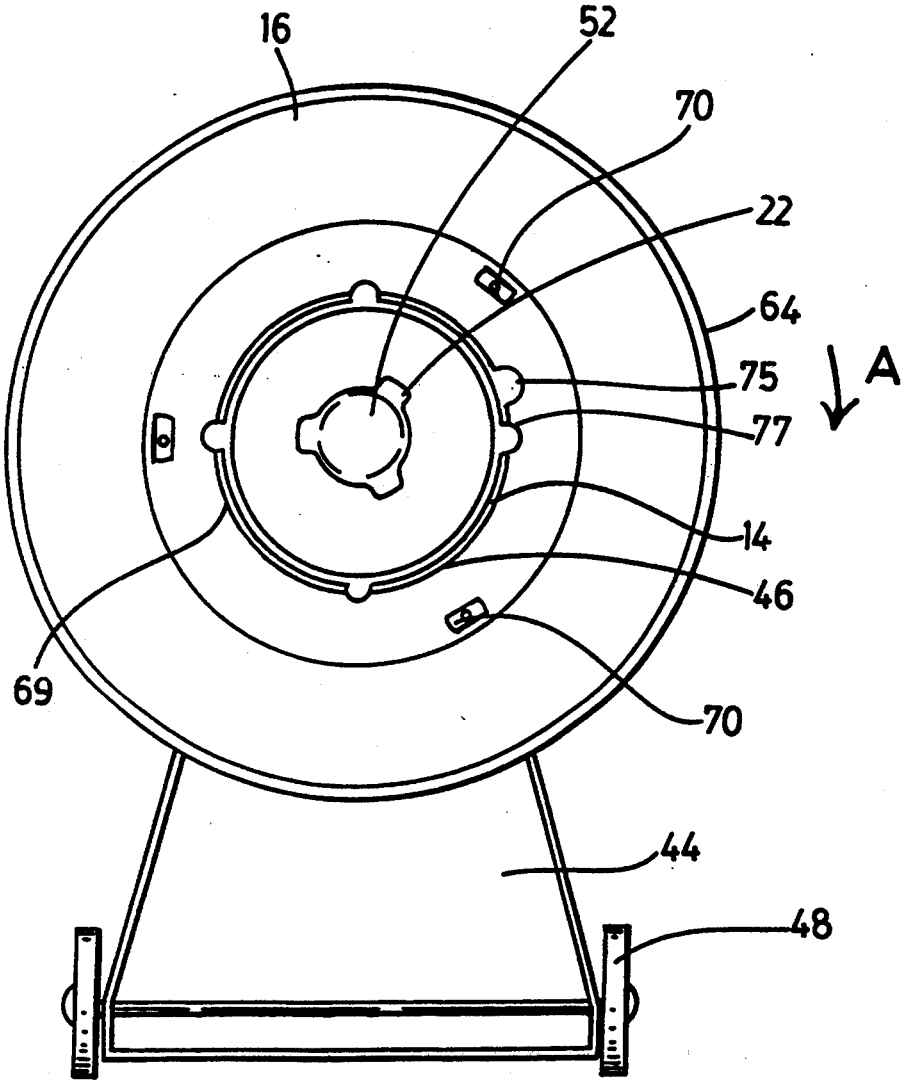
FIGS. 11, 11B, and 11C are sketches showing interchanging of floor treatment discs and hoods.

FIGS. 11A, B and C illustrate the changing of hood 16 for a smaller hood 16A. FIGS. 11A, B and C are views of the floor machine from below somewhat similar to the view of FIG. 3. The floor machine 10 of FIGS. 11A, B and C however does not have the vertical guides comprising shoulders 67 and grooves 71 as shown in FIG. 3. Hood 16 is provided with a notch 75 complementary to tabs 77 which project from collar 14 to hold the hood 16 thereabove.

Figure 11B:
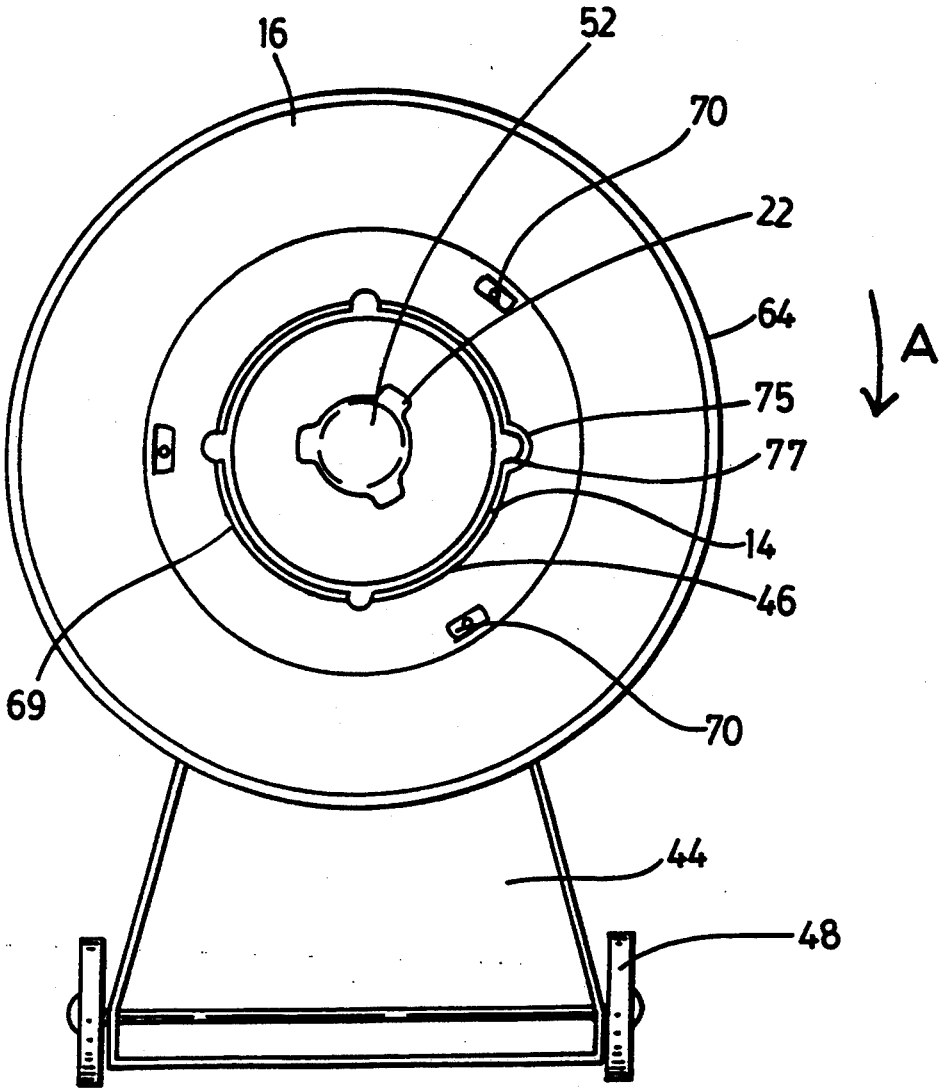
Figure 11C:
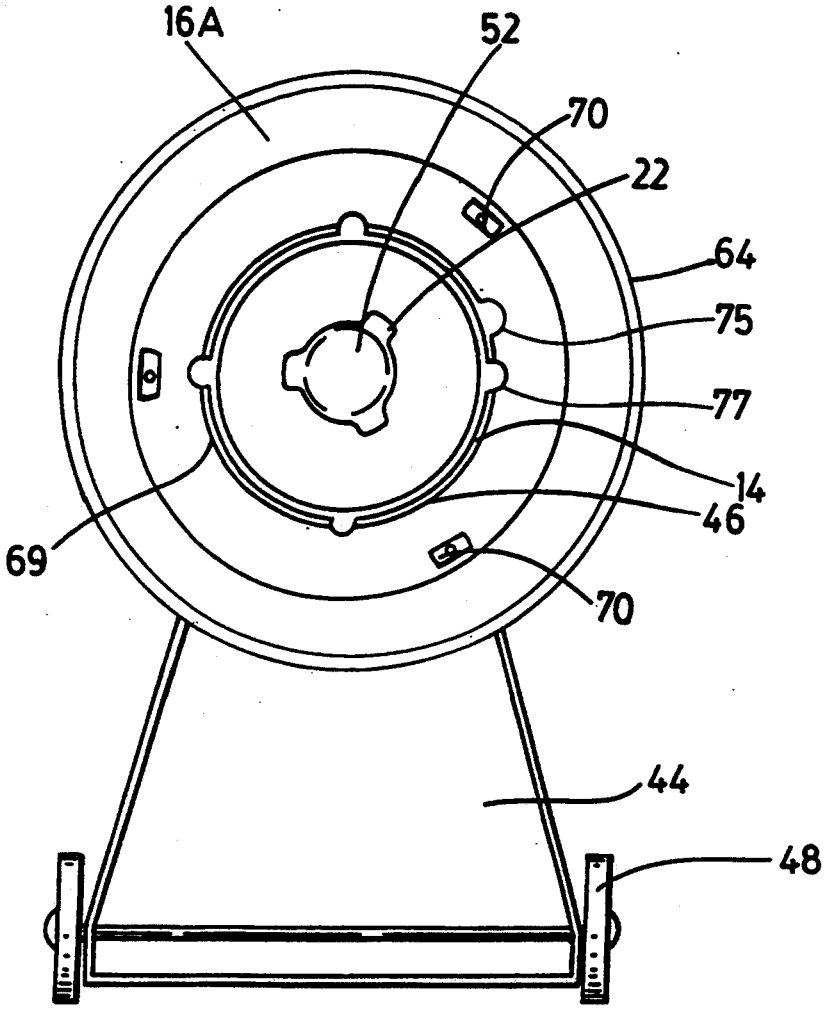

When it is desired to change hood 16 it is rotated in the direction of arrow A of FIG. 11A so that one of the tabs 77 and the notch 75 are one above the other as shown in FIG. 11B. Pressure is exerted on the hood 16 to press the tab 77 through notch 75 and rotation in the direction of arrow A is continued. When notch 75 reaches the next tab 77, this also is pressed through the notch 75. When all the tabs 77 have been pressed through the notch 75 the hood 16 is free from the machine. Smaller hood 16A may be attached by reversing the above procedure.

Many other mechanisms are clearly within the scope of the appended claims.

We claim:

1. A floor machine comprising:

a rotatable floor treatment disc having a floor treatment surface and an upper surface;

a motor to drive said disc on a drive shaft;

a hood extending over and peripherally downwardly over the disc;

a collar about the shaft and fixed in position with respect to the motor;

downwardly extending fastening means to fasten the hood to the collar, in first working position in which said hood is fixed with respect to the motor and the disc to leave a clearance between a first plane defined by a lower rim of the periphery of the hood and a second plane defined by the treatment surface;

the fastening means being releasable to allow the hood to drop freely over the disc to a second working position in which it is free with respect to the motor and in which the first and second planes are coincident.

2. A floor machine as claimed in claim 1 in which the disc is located to support the machine on the floor.

3. A floor machine as claimed in claim 2 in which a pair of axially aligned wheels are provided for additional support, the wheels bearing in a rearwardly directed extension on the collar.

4. A floor machine as claimed in claim 3 in which an elongate handle is pivoted to the collar to pivot between an upright position vertical to the plane disc and the hood and a flat position generally parallel to the plane of the disc and the hood.

5. A floor machine as claimed in claim 4 in which the handle has a releasable clamping sleeve thereabout, the sleeve being clampable in fixed position on the handle and releasable to slide thereon, and a strut pivoted on one end to the clamping sleeve and, at another end, to the collar extension, whereby sliding of the clamping sleeve on the handle moves the handle between the upright and flat position.

6. A floor machine as claimed in claim 5 in which the sleeve is clampable to fix the handle in intermediate position convenient to an operator.

7. A floor machine as claimed in claim 6 in which the handle terminates at a distal end with a pair of branching handlebars.

8. A floor machine as claimed in claim 7 in which the sleeve has a hook projecting therefrom, the hook and at least one handlebar forming a rack for winding electrical cord thereon.

9. A floor machine as claimed in claim 8 in which sliding of the sleeve on the handle toward the distal end acts to loosen electrical cord wound between the hook and at least one handlebar.

10. A floor machine as claimed in claim 2 in which the hood is disengageable from the collar for interchangeability with another hood.

11. A floor machine as claimed in claim 1 in which vertical guides are provided to restrain the hood to drop vertically over the disc to its free position.

12. A floor machine as claimed in claim 1 in which the fastening means comprises bolts extending through the collar to engage the hood in its fixed position and to release the hood in its free position.

13. A floor machine as claimed in claim 12 in which the bolts have heads adapted for manual operation.

14. A floor machine comprising:

a rotatable floor treatment disc having a floor treatment surface and an upper surface;

a motor to drive a drive shaft for, said disc;

means to attach the floor treatment disc at right angles to the drive shaft, at a distal end thereof;

a hood extending over and peripherally downwardly over the distal end of the drive shaft to extend over the disc to a collar about the axle and fixed in position with respect to the motor;

downardly extending fastening means to fasten the skirt to the collar, in fixed position with respect to the motor and the disc to leave a clearance between a first plane defined by the periphery of the skirt and a second plane defined by the treatment surface;

the fastening means being releasable to allow the hood to drop freely over the drive shaft to a free position in which the first and second planes are coincident.

* * * * *